United States Patent [19]

Reinhall

[11] 4,283,016

[45] * Aug. 11, 1981

[54] METHOD AND APPARATUS FOR CONTROLLING THE EFFECT OF THE CENTRIFUGAL FORCE ON THE STOCK IN PULP DEFIBRATING APPARATUS

[76] Inventor: Rolf B. Reinhall, 834, 171st Pl., NE., Bellevue, Wash. 98008

[ * ] Notice: The portion of the term of this patent subsequent to Mar. 3, 1998, has been disclaimed.

[21] Appl. No.: 21,184

[22] Filed: Mar. 16, 1979

[51] Int. Cl.[3] ..... B02C 7/12

[52] U.S. Cl. ..... 241/21; 241/28; 241/247; 241/251; 241/259.2; 241/261.3

[58] Field of Search ..... 241/21, 18, 38, 246, 241/247, 251, 259.1, 259.2, 261, 261.2, 261.3, 260, 296

[56] References Cited

U.S. PATENT DOCUMENTS

| | | | |
|---|---|---|---|
| 3,040,997 | 6/1962 | Borden | 241/261.3 |
| 3,214,104 | 10/1965 | Breuninger et al. | 241/261.2 X |
| 3,746,270 | 7/1973 | Moore, Sr. | 241/251 |
| 4,090,672 | 5/1978 | Ahrel | 241/261.3 X |

FOREIGN PATENT DOCUMENTS

| | | | |
|---|---|---|---|
| 1964382 | 7/1971 | Fed. Rep. of Germany | 241/261.2 |
| 1059781 | 8/1963 | United Kingdom | 241/261.2 |

*Primary Examiner*—Mark Rosenbaum
*Attorney, Agent, or Firm*—Eric Y. Munson

[57] ABSTRACT

A method and apparatus is provided for controlling the effect of centrifugal force on pulp stock while being ground in the grinding space of a defibrating apparatus. The grinding space includes a central portion, a first grinding zone defined between first and second rotatable grinding discs and extending outwards from the central portion, and a second grinding zone extending angularly from the outer end of the first grinding zone and being defined between one of the rotatable grinding discs and a stationary grinding surface. Pulp stock to be ground is introduced into the central portion and accelerated through the first and second grinding zones by centrifugal force generated by the rotating discs. The angular second grinding zone serves to retard centrifugal force acting on the pulp in the second grinding zone to increase the dwell time of the pulp in the grinding space for achieving optimum refining efficiency.

9 Claims, 2 Drawing Figures

14
58
42
26
34
16
46
44
64
62
48
56
50
52
54
12
60
66
30
24
35
22
38
36
28
18
40
20
32

METHOD AND APPARATUS FOR CONTROLLING THE EFFECT OF THE CENTRIFUGAL FORCE ON THE STOCK IN PULP DEFIBRATING APPARATUS

BACKGROUND OF THE INVENTION

In the refining process to which the grinding discs according to the invention are particularly applicable, the pulp stock or grist is ground in a grinding space defined between a pair of discs which rotate relative to one another in an environment of fluid medium. Each disc comprises disc segments disposed annularly about the discs and is provided with ridges and grooves which shear the fibers of the grist in grinding-like fashion. The pulp material, which may consist of wood chips, bagasse, fiber pulp or similar fibrous material, is fed by a screw feeder or the like through an opening in the central portion of one of the grinding discs into the "eye" of the grinding space and from which it is propelled by the centrifugal force generated by the rotational movement of the discs towards their periphery, where the grist is ejected with greatly accelerated force into the surrounding casing.

In order to generate the necessary centrifugal force to accelerate the stock from the inner central portion of the grinding space radially outwards and to obtain the desired degree of defibration and operating capacity in the grinding space, a high rotational speed must be imparted to the discs, such as on the order of 1500 r.p.m. to 3600 r.p.m.. However, the resultant relatively high centrifugal force required to accelerate the stock from the inner disc portion, which determines the capacity of the apparatus, concommitantly subjects the grist as it progresses radially outwards to the outer disc portion to a progressively intensified centrifugal force. This intensified centrifugal force will accelerate the outward radial speed of the grist to such a degree that, unless special measures are taken to hold back the grist in the outer disc portion, the grist will be ejected prematurely from the grinding space, in only partly-treated condition, with consequent impairment of the defibration efficiency of the grinding apparatus. This problem becomes even more accentuated when steam or other vapor is generated during the grinding operation, as the result of high power input or dryness of the grist. The steam or other vapor will then flow with the grist outward through the grinding space between the discs and further accelerate the radial flow of the grist. As the centrifugal acceleration exerted on the grist is proportional to the disc diameter, as well as to the square of the r.p.m. of the disc, according to Newton's law of force and motion, the larger the diameter of the disc in the apparatus, the greater will be the problem of controlling the flow of the grist through the outer portion of the grinding space. Depending on application and capacity demand, grinding apparatuses used today normally have a disc diameter ranging between 20" and 64". Even if the larger diameter discs should be rotated at relatively slow speeds varying between 900 r.p.m. and 1800 r.p.m., they will still produce a centrifugal force of acceleration on the grist in the order of 700 g's to 2800 g's. Assume, for example, that a disc rotating at 900 r.p.m. generates a centrifugal force of 700 g's; if the r.p.m. should be increased to 1800 r.p.m., the centrifugal force will be increased by a factor of 4, thus generating an increased centrifugal force of 2800 g's.

While discs of large diameter are desirable for capacity reasons, they require large amounts of energy, which is partly wasted because of their high peripheral velocity and consequent intensified centrifugal force, which renders the peripheral portion of the grinding space substantially ineffective for defibrating purposes. In addition, the high peripheral velocity of these large discs creates a serious noise problem.

Because of increasing demand for large capacity defibration equipment with adequate refining efficiency, it has proved to be a problem in the industry to properly control the radial passage of the stock between the outer part of the opposed grinding disc segments so as to obtain maximum performance. It should be understood that, as the stock progresses through the radial passage, it migrates alternately between the grinding segments on the opposing discs, and the more work on the stock in a single pass, i.e., the longer the dwell time in the grinding space, the more efficient and economical becomes the refining process. Unless the stock flow is properly retarded, the movement of the pulp becomes too rapid, as explained herein, and the defibrating action is minimized. Heretofore, attempts have been made to retard the passage of the grist through the grinding space by arranging the ridges and grooves in the grinding segments so that they can serve additionally as flow retarders. Such attempts are exemplified by applicant's U.S. Pat. Nos. 3,674,217, dated July 4, 1972, and 3,974,471, dated Aug. 17, 1976; and U.S. Pat. No. 3,040,997 granted to Donald A. Borden on June 26, 1962, U.S. Pat. No. 3,125,306 to E. Kollberg et al and U.S. Pat. No. 1,091,654 to Hamachek.

While these ridges and grooves serve to retard the flow, they still do not provide full utilization of the entire working area of the grinding space, since the grooves or channels between the ridges are spread out over a greater area at the periphery than at the inner portion of the grinding space. Furthermore, they do not solve the problem associated with high peripheral velocity of the presently-used large-diameter discs.

Another attempt to solve the problem of controlling the flow is exemplified by U.S. Pat. No. 4,090,672 dated May 23, 1978, to Bo A. Ahrel. The primary object of that invention is to solve the problem created by the high pressure steam in the peripheral zone of the grinding space. In order to prevent the partly defiberized stock from being blown out from the peripheral grinding zone by the high velocity steam, Ahrel utilizes the centrifugal force to separate the stream and to open up an escape passage for the steam while retaining the steam-liberated stock between the opposing grinding surfaces.

Other examples of prior art are U.S. Pat. Nos. 1,098,325 1,226,032, 3,684,200 and 3,845,909; German Pat. No. 1,217,754 and Swedish Pat. No. 187,564.

My co-pending patent application Ser. No. 877,809 filed on Feb. 17, 1978, discloses a method and apparatus for controlling the effect of centrifugal force on pulp stock while being ground in the grinding space of a defibrating apparatus. The preferred embodiment discloses a grinding space defined between a first stationary grinding disc and a second rotatable grinding disc. The grinding space comprises a first grinding zone in a plane substantially perpendicular to the axis of rotation of the grinding discs, and a second grinding zone extending at an angle from the first grinding zone. The angle of the second grinding zone relative to the first grinding zone is calculated to retard the centrifugal force in the outer peripheral portion of the grinding discs, so as to cause the pulp stock to progress through the grinding space at a controlled rate of flow with full utilization of the entire working area of the grinding space and without any substantial fluid separation regardless of the dimension of the grinding discs.

The preferred embodiment of my co-pending application also discloses further control of the effect of centrifugal force on pulp stock by varying the degree of the angle between ridges and grooves of the opposing disc segments relative to the generatrix of the grinding space in the outer inclined grinding zone.

OBJECT OF THE INVENTION

The principal object of the present invention is to provide an improved method and apparatus for controlling the effect of centrifugal force on pulp stock as it is passed through a grinding space having a first portion being defined between the grinding segments of two opposed rotatable grinding discs and having a second portion extending angularly from the first portion and being defined between the grinding surface of one of the grinding discs and a stationary grinding surface, so as to utilize the entire working area of the grinding space without special additional retarding means while maintaining the stock in the environment of a fluid medium throughout its passage in the grinding space and to prevent the escape of grist from the grinding space as the grist passes from the first to the second portion of the grinding space.

SUMMARY OF THE INVENTION

The invention contemplates first and second opposed rotatable grinding discs defining a first inner grinding zone therebetween. A second grinding zone, which extends at an angle from the first inner grinding zone, is defined between the first rotatable grinding disc and a stationary grinding surface. The stationary grinding surface is defined on a portion of the surface of a fixed element, as, for example, a stator ring. A gap between the periphery of the second rotatable grinding disc and the adjacent surface of the fixed element prevents contact between the periphery of the second rotatable disc and the fixed adjacent surface when the second disc is spinning. The gap, at one of its ends, opens into the grinding region at the region in which the first grinding zone merges with the second grinding zone.

The angle of the second grinding zone relative to the first grinding zone is calculated according to the dimensions of the rotatable grinding discs and the dwell time required for optimum refining efficiency. In the first grinding zone, full utilization of centrifugal force is maximized in order to increase the accelerating force on the stock to move it continuously away from the feed in opening or "eye" of the first grinding zone. In the second grinding zone, the centrifugal force is split into a radial vector force and an axial vector force, thus reducing the accelerating force in the direction of outward flow, while prolonging the dwell time in the grinding zones, with resultant utilization of each zone for optimum refining efficiency.

To prevent the pulp stock from becoming entrapped within the gap between the periphery of the second rotatable grinding disc and the stationary adjacent grinding surface as the pulp stock passes from the first to second grinding zone, a pressurized fluid medium, as for example, water, steam or an aqueous solution of chemicals is jetted through the gap. This flowing fluid acts as a seal to prevent any collection of grist in the gap which would cause plugging and result in frictional forces impeding the spinning movement of the adjacent second rotatable grinding disc. Channels provided along the stator ring guide the fluid towards the gap, and a plurality of wings (or projections) machined to the periphery of the second rotatable grinding disc accelerate the flow of the fluid in the gap in the direction of the grinding zones. By adjusting the flow of fluid through the channels on the stator ring, a sufficient hydraulic pressure can be maintained in the gap to assure that the fluid will be conducted to the grinding zones, thereby preventing grist from collecting in and plugging the gap.

DETAILED DESCRIPTION OF THE PREFERRED EMBODIMENT OF THE INVENTION

Figure 1:
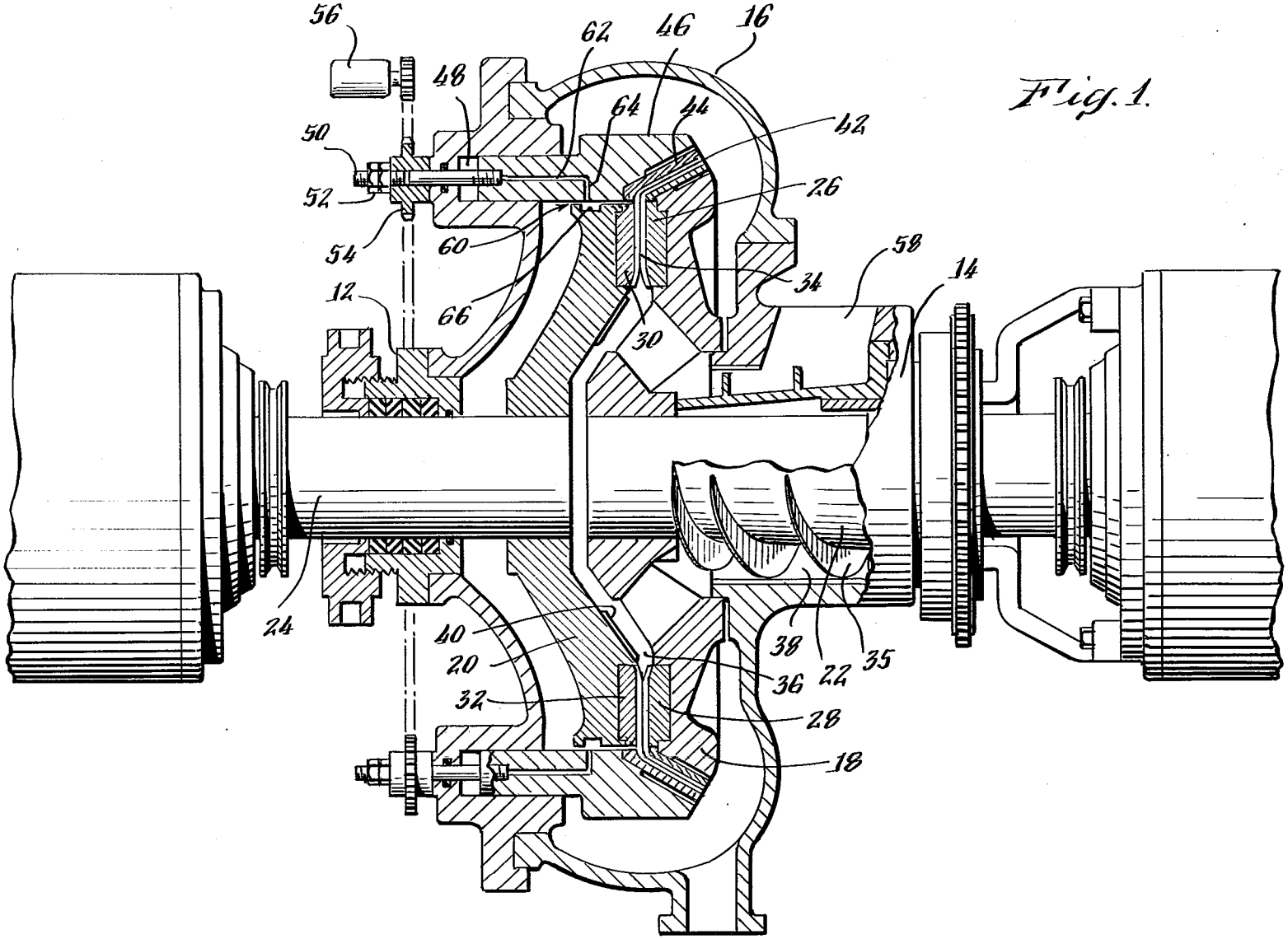
FIG. 1 is a vertical section of a portion of a defibrating apparatus embodying the invention disclosed herein.

Referring to FIG. 1, reference numeral 10 indicates a pressure sealed casing or housing which is sealed by packing boxes 12 and 14. The housing has a removable segment indicated by numeral 16. A first rotatable disc 18 and a second rotatable disc 20 are mounted within the housing on shafts 22 and 24, respectively. The shafts are journaled into a frame of the apparatus in the conventional manner, as for example, in U.S. Pat. No. 3,212,271. The opposing forces of the discs are provided with conventional grinding segments 26, 28, and 30, 32, as shown, for example, in U.S. Pat. No. 3,974,491, defining a first grinding zone 34 therebetween. This first grinding zone extends radially outwardly and is substantially perpendicular to the plane of the axis of rotation of the rotatable discs. The raw material, for example, wood chips which have previously been conventionally steamed and preheated in a steaming vessel (as shown, for example, in U.S. Pat. No. 4,030,969) is fed by, for example, concentric screw 35 surrounding the shaft 22, through a central opening in the first disc 18 which forms a feed-out zone or "eye" 36 in the throat member 38 which is connected to the frame of the apparatus. From the "eye" 36, the steamed chips or the like are accelerated radially outwards by the centrifugal force created by the rotational movement of the first and second discs 18 and 20.

The grinding segments 26 and 28, 30 and 32 on the discs 18 and 20 are removably mounted in conventional manner, as shown, for example, in U.S. Pat. No. 3,827,644. These grinding surfaces may be defined on the surfaces of rings, as disclosed in aforementioned co-pending U.S. application Ser. No. 877,809. A deflector member 40 may also be provided to deflect the material in the "eye" 36 into the first grinding zone 34. The spacing of the first disc 18 in relation to the second disc 20 can be conventionally adjusted by means of an adjusting mechanism (not shown), as for example shown in the aforesaid U.S. Pat. No. 3,827,644.

The radial first grinding zone 34 merges with an inclined second outer grinding zone 42, which as shown in FIG. 1 extends at an angle relative to the first grinding zone, thus forming a combined grinding space having a frustoconical profile in the example shown.

As more fully explained in co-pending U.S. application Ser. No. 877,809 filed Feb. 17, 1978, the combined grinding space comprising the joined first and second grinding zone retards the centrifugal force acting on the raw material introduced into the first grinding zone, and accordingly retards the outward acceleration of these materials. Consequently, the dwell time of the raw material in the grinding zones is prolonged, with resultant utilization of each grinding zone for optimum refining efficiency. Briefly stated, the inclined angle of the second grinding zone splits the centrifugal force acting upon the raw material into a radial vector force and an axial vector force, thus reducing the accelerating force in the direction of outward flow, while prolonging the dwell time of the material in the grinding space. More specifically, the angle of the second angular grinding zone relative to the first grinding zone can be calculated to split the centrifugal force exerted on the pulp material in the second angular grinding zone into two different force vectors to thereby reduce the accelerating force on the pulp flowing through the second grinding zone, thus prolonging the dwell time of the pulp in the grinding space. This concept is significant when the defibration operation is performed in an environment of a fluid medium under superatmospheric pressure and correspondingly elevated temperature within a housing of a defibrating apparatus. Under such circumstances, the centrifugal force generated by the rotating grinding discs, as previously discussed in the BACKGROUND section herein, would prematurely eject the pulp from the grinding space, thus impairing the defibration efficiency of the defibrator, unless the acceleration of the pulp through the grinding space is retarded. This concept is more fully analyzed in the aforementioned co-pending U.S. application Ser. No. 877,809.

Referring back to FIG. 1 of the drawings, the second grinding zone 42 is defined between a portion of the grinding surface of the first rotatable disc 18, and a stationary grinding surface 44 defined on a portion of a stationary element, as for example, the inner surface of a displaceably journaled stator ring 46, adjustably mounted to the housing 10. The distance between the stationary grinding surface 44 and the grinding surface of the first rotatable grinding disc 18 is adjustable by means of a hydraulic medium of suitable pressure within the chamber 48. Pressure of the hydraulic medium can be used to displace the stator ring in a direction towards the first rotatable grinding disc, and accordingly, decrease the width of the second grinding zone 42. Such movement is restricted by a plurality of screw tappets 50 arranged around the stator ring and a plurality of stop nuts 52. The stop nuts are simultaneously driven by a chain drive 54 and a motor 56. Thus, the width of the second grinding zone 42 can be adjusted independently of the width of the first grinding zone 34, and vice versa.

Removable segment 16 of the housing 10, which can be pressure sealed against the housing when the apparatus is operating, can be removed to provide access to the grinding segments of the grinding surfaces for repair and replacement thereof. The housing also has a discharge opening 58 which can be provided with a blow valve (not shown).

Figure 2:
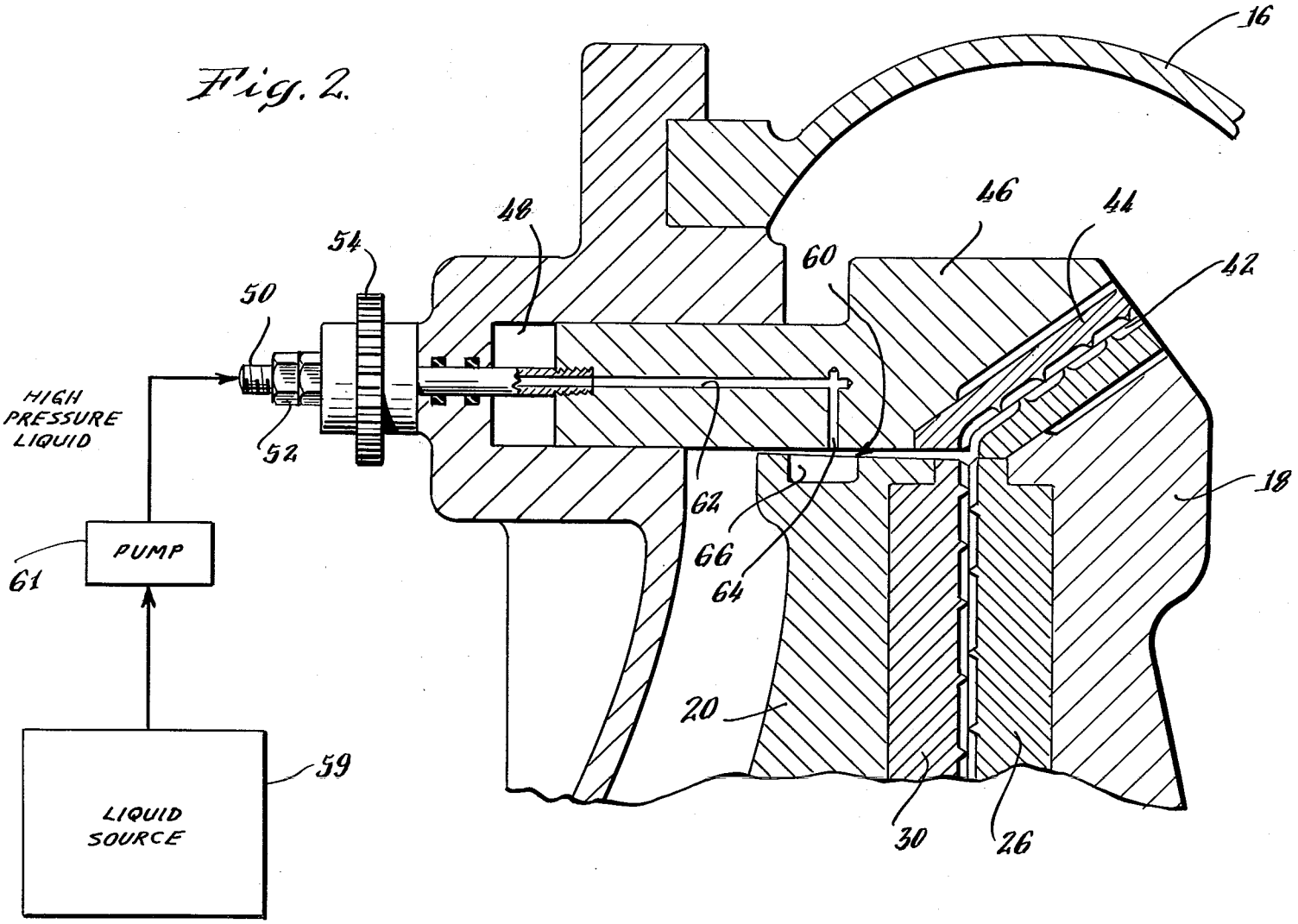
FIG. 2 shows a blown-up portion of the defibrating apparatus illustrated by FIG. 1.

Referring to FIG. 2, the second rotatable disc 20 and the stator ring 46 are relatively mounted within the housing to define a gap 60 between the adjacent portions of the periphery of the second disc and the inner surface of the stator ring. The gap 60 prevents contact and scraping between the stationary stator ring and the second disc 20, when this second disc is rotating.

As seen from FIG. 1 and more clearly from FIG. 2, the gap 60 intersects and opens into the grinding space of the apparatus at the approximate region where the first grinding zone 34 merges with the second angled grinding zone 42. Consequently, there is a possibility that a portion of the raw material or grist passing through the first grinding zone will enter the gap 60, causing plugging of that gap. This possibility is enhanced because the gap opens into the region of the grinding area at which the angled second grinding zone merges with the first grinding zone. Because the direction of flow of the grist is changed in this region of the grinding area, a portion of the grist can be deflected into the gap 60. Plugging of the gap by the grist is quite undesirable because such plugging will interfere with the rotating motion of the second grinding disc 20 and also generate heat due to frictional forces, thereby reducing the efficiency of the apparatus. Furthermore, grist entering the gaps would be lost from the defibrating process, thereby wasting material.

To avoid the possibility of any such undesirable effects, the presently described invention includes means for preventing plugging of the gap 60 by grist or other materials passing through the grinding zones. Specifically referring now to FIGS. 1 and 2, a plurality of channels 62 are associated with the stator ring 46. These channels conduct a fluid, as for example, water introduced at one end of the channels, to the gap 60. As shown by FIG. 2, water from a liquid source 59 is pumped into one end of the channel 62 by pump 61. The water flows under pressure in the channel towards the gap 60. The region in which the water is introduced into the gap 60 is indicated by numeral 64 on FIGS. 1 and 2.

A plurality of wings (or projections) 66 extend from the second rotatable disc 20 near the periphery thereof in the region 64 proximate to where the water (or other fluid) is introduced into the gap 60 via the channels 62. These wings can be machined to the second disc. When the second disc 20 rotates, the spinning wings tend to propel any water (or other fluid) introduced into the gap towards the grinding space. (That is, towards the right on FIGS. 1 and 2). FIG. 2 clearly illustrates that the periphery of disc 20 is angled relative to the inner surface of the stator ring 46 so that the gap 60 is wider towards the grinding space, further assuring that substantially all of the water introduced into the gap from the channels 62 will be propelled in the direction towards the grinding space.

The pressure of the accelerating water acts as a seal to prevent grist and other materials in the grinding zones from entering the gap 60. In other words, the pressure of the accelerating water is maintained above the pressure within the first and second grinding zones so the water pressure provides a pressure barrier in the gap which prevents entry of grist into the gap. The specific water pressure in the gap can be controlled by such factors as the diameter of the channels 62, the width of the gap 60, the speed of rotation of the second disc 20, the pressure of the water when first introduced into the channels 62, and the position and configuration of the wings 66, the proper adjustment of these factors being within the skill of those knowledgeable in the art.

By providing the appropriate water pressure, the water accelerating through the gap 60 will enter the grinding space at the region where the first grinding zone 34 merges with the second grinding zone 42. Any excess pressure caused by the vaporization of the water within the housing can be discharged through the discharge opening 58.

Thus, the invention hereinabove described constitutes an improvement over the apparatus described in co-pending U.S. application Ser. No. 877,809, filed Feb. 17, 1978. The presently described embodiment includes two rotatable grinding discs defining a first grinding zone therebetween. A second grinding zone, extending angularly from the first grinding zone, is defined between the first grinding disc and a stationary grinding surface. A gap, defined between the stationary grinding surface and the periphery of the second grinding disc, prevents scraping between these elements when the second disc rotates. Means are provided to prevent material in the grinding space from collecting in the gap, thereby avoiding the undesirable results of any such plugging.

The description of the invention provided herein is intended to be illustrative only, and not restrictive of the scope of the invention, that scope being defined by the following claims and all equivalents thereto.

I claim:

1. In the method of refining pulp stock in which the pulp material to be ground is introduced into a grinding space including a first grinding zone defined between a first grinding disc opposing a second grinding disc having ridges and grooves providing grinding surfaces, which discs rotate relative to each other in an environment of fluid medium in a housing, and in which first grinding zone the pulp material is accelerated outwardly by the centrifugal force generated by the rotational movement of the rotatable disc, the improvement for controlling the effect of the centrifugal force on the pulp comprising; p1 providing a second grinding zone extending angularly from said first grinding zone for receiving the pulp accelerated through said first grinding zone and changing its direction of flow, said second grinding zone being defined between said first rotatable disc and a stationary grinding surface on at least a portion of the surface of a stationary element mounted within said housing.

2. The method of claim 1 further including the steps of:

spacing said stationary element apart from said second rotatable disc to provide a gap therebetween for preventing contact between said second rotatable disc and said stationary element, one end of said gap opening into said grinding space at the area in which said first grinding zone merges with said second angular grinding zone where said pulp changes flow direction, and introducing a pressurized fluid into said gap for preventing the pulp in said grinding space from plugging said gap.

3. In the method of refining pulp stock in which the pulp to be ground is introduced into a grinding space including a first grinding zone defined between opposing grinding discs having ridges and grooves providing grinding surfaces, which discs are carried by a pair of rotatable discs which rotate relative to each other in an environment of fluid medium under superatmospheric pressure and correspondingly elevated temperature in a housing, and in which first grinding zone the pulp material is accelerated outwardly by the centrifugal force generated by the rotational movement of the rotatable discs, the improvement for controlling the effect of the centrifugal force on the pulp comprising the step of:

providing a second grinding zone extending angularly from said first grinding zone for receiving the pulp accelerated through said first grinding zone and changing its direction of flow, said second grinding zone being defined between one of said rotatable discs and a stationary grinding surface on at least a portion of the surface of a stationary element mounted within said housing, the angle of said second grinding zone relative to said first grinding zone being calculated to split the centrifugal force exerted on the pulp material in said second grinding zone into two different force vectors to thereby reduce the accelerating force on the pulp in said second grinding zone to prolong the dwell time of said pulp in said grinding space.

4. In a pulp defibrating apparatus in which the pulp material to be ground is introduced into a grinding space including a first grinding zone defined between a first grinding disc opposing a second grinding disc having ridges and grooves providing grinding surfaces, which discs rotate relative to each other in an environment of a fluid medium in a housing, and in which first grinding zone the pulp material is accelerated outwardly by the centrifugal force generated by the rotational movement of the rotatable discs, the improvement for controlling the effect of the centrifugal force on the pulp comprising:

a stationary element having a stationary grinding surface defined thereon, said stationary element being mounted in said housing with said stationary grinding surface being opposed to said grinding surface of said first rotatable grinding disc for defining a second grinding zone therebetween, said stationary element and said first rotatable grinding disc being so configured and positioned that said second grinding zone defined therebetween extends from the outer end of said first grinding zone for receiving the pulp therefrom and that said second grinding zone is angled relative to said first grinding zone for causing said pulp to change its direction of flow upon entering said second grinding zone.

5. The apparatus as claimed in claim 4, wherein said stationary element is spaced apart from said second rotatable grinding disc defining a gap therebetween for preventing contact between said second rotatable disc and said stationary element, one end of said gap opening into said grinding space at the area in which said first grinding zone merges with said second grinding zone where said pulp changes direction of flow, and means for introducing a pressurized fluid into said gap for preventing pulp material in said grinding space from plugging said gap.

6. The apparatus as claimed in claim 5, wherein said stationary element is angled relative to said second rotatable disc in a direction such that said gap increases in width towards said grinding space.

7. The apparatus as claimed in claim 4, including first means for adjusting the position of said second rotatable disc relative to the position of said first rotatable disc for varying the width of said first grinding zone, and second means for adjusting the position of said stationary element relative to said first rotatable disc for varying the width of said second grinding zone, whereby the widths of said first and second grinding zones are independently adjustable.

8. The apparatus claimed in claim 4, including first means for adjusting the position of one of said rotatable discs and second means for adjusting the position of said stationary element such that the widths of said first and second grinding zones are independently adjustable.

9. In a pulp defibrating apparatus in which the pulp material to be ground is introduced into a grinding space including a first grinding zone defined between opposing grinding discs having ridges and grooves providing grinding surfaces, which discs are carried by a pair of rotatable grinding discs which rotate relative to each other in an environment of fluid medium under superatmospheric pressure and correspondingly elevated temperature in a housing, and in which first grinding zone the pulp material is accelerated outwardly by centrifugal force generated by the rotational movement of the rotatable discs, the improvement for controlling the effect of centrifugal force on the pulp comprising:

a stationary element having a stationary grinding surface defined thereon, said stationary element being mounted in said housing with said stationary grinding surface being opposed to said grinding surface of one of said rotatable discs for defining a second grinding zone therebetween, said stationary element and said one of said rotatable discs being so configured and positioned that said second grinding zone defined therebetween extends from the outer end of said first grinding zone for receiving the pulp therefrom and that said second grinding zone is angled relative to said first grinding zone for causing said pulp to change its direction of flow upon entering said second grinding zone, the angle of said second grinding zone relative to said first grinding zone being calculated to split the centrifugal force exerted on the pulp material in said second grinding zone into two different force vectors to thereby reduce the accelerating force on the pulp in said second grinding zone to prolong the dwell time of said pulp in said grinding space.

* * * * *